US007172535B2

(12) United States Patent
Volmar

(10) Patent No.: US 7,172,535 B2
(45) Date of Patent: Feb. 6, 2007

(54) UPPER BACK EXERCISE MACHINE AND METHOD OF USE

(76) Inventor: John F. Volmar, 729 Owl Hollow Rd., Knoxville, TN (US) 37923

( * ) Notice: Subject to any disclaimer, the term of this patent is extended or adjusted under 35 U.S.C. 154(b) by 274 days.

(21) Appl. No.: 10/975,142

(22) Filed: Oct. 28, 2004

(65) Prior Publication Data

US 2006/0100068 A1 May 11, 2006

(51) Int. Cl.
*A63B 21/062* (2006.01)
*A63B 23/12* (2006.01)
*A63B 23/02* (2006.01)

(52) U.S. Cl. ..... 482/101; 482/135

(58) Field of Classification Search ..... 482/91–94, 482/98, 99, 101, 133–135, 138, 83, 89, 141; 473/443

See application file for complete search history.

(56) References Cited

U.S. PATENT DOCUMENTS 1,548,849 A * 8/1925 Ruden ..... 482/128
3,114,549 A * 12/1963 Hooker ..... 473/443
3,424,458 A * 1/1969 Hopps, Jr. ..... 473/443
4,614,338 A * 9/1986 Castillo ..... 482/98
4,635,929 A * 1/1987 Shustack ..... 482/89
4,720,099 A 1/1988 Carlson
4,720,103 A * 1/1988 Palladino, Jr. ..... 473/438
4,730,829 A 3/1988 Carlson
4,799,671 A * 1/1989 Hoggan et al. ..... 482/100
4,804,179 A 2/1989 Murphy et al.
4,828,252 A * 5/1989 Bowen et al. ..... 482/98
4,951,943 A * 8/1990 Farenholtz ..... 482/138
5,147,259 A * 9/1992 Hutchins ..... 482/101
5,260,870 A * 11/1993 Tsuchiya et al. ..... 600/595
5,299,998 A * 4/1994 Hutchins ..... 482/101
5,383,831 A * 1/1995 Drath ..... 482/101
5,460,587 A * 10/1995 Hutchins ..... 482/101
5,556,363 A 9/1996 Hutchins
5,637,063 A 6/1997 Fuller, Sr.
5,692,997 A 12/1997 Stearns
6,149,554 A * 11/2000 Ferguson ..... 482/83
6,234,941 B1 5/2001 Chu
6,394,936 B1 5/2002 Voris
6,394,937 B1 5/2002 Voris
6,533,709 B1 3/2003 Jones
6,824,504 B2 * 11/2004 Ott ..... 482/92
6,858,625 B1 * 2/2005 Yazaki et al. ..... 482/83

* cited by examiner

*Primary Examiner*—Jerome Donnelly
*Assistant Examiner*—Victor K. Hwang
(74) *Attorney, Agent, or Firm*—Pitts & Brittian, P.C.

(57) ABSTRACT

An exercise apparatus for isolating and strengthening upper back and shoulder muscles including opposed first and second outboard support members containing separate and opposed sets of stacked weights supported for reciprocation vertically, and an upper cross-member containing a pair of aligned upper roller tracks. The frame includes a pair of inboard first and second crossbars supported at opposed ends in upper and lower roller tracks of the frame, such that the crossbars are manipulated in opposed outwardly directions by the user positioned therebetween. Separate cables and supporting pulleys are utilized to extend between first and second crossbars for connections to respective opposed sets of stacked weights, allowing for concurrent movement of weights when each crossbar is moved laterally outwardly and inwardly by user's right and left hands in palm-out orientation, thereby isolating and strengthening the user's upper back and shoulder muscles.

12 Claims, 6 Drawing Sheets

UPPER BACK EXERCISE MACHINE AND METHOD OF USE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to the field of exercise equipment. More particularly, the present invention relates to an exercise machine providing isolation and strengthening of a user's upper back and shoulder muscles.

2. Description of the Related Art

In the field of exercise equipment, it is known that a person can strengthen the muscles of his/her arms, legs, and torso by utilizing exercise equipment in which they assume prone or reclining positions during the manipulation of hand weights in a vertical direction, or during repetitive arm movements while manipulating levered or pivoting mechanisms connected to weights. Various devices have been developed to accomplish strengthening of a user's upper torso muscles, as disclosed in the following U.S. patents.

| U. S. Pat. No. | Inventor(s) | Issue Date |
|---|---|---|
| 4,720,099 | R. B. Carlson | Jan. 19, 1988 |
| 4,730,829 | R. B. Carlson | Mar. 15, 1988 |
| 4,804,179 | R. J. Murphy, et al. | Feb. 14, 1989 |
| 5,556,363 | K. M. Hutchins | Sep. 17, 1996 |
| 5,637,063 | B. R. Fuller, Sr. | Jun. 10, 1997 |
| 5,692,997 | K. W. Stearns | Dec. 2, 1997 |
| 6,234,941 | Y. S. Chu | May 22, 2001 |
| 6,394,936 | H. C. Voris | May 28, 2002 |
| 6,394,937 | H. C. Voris | May 28, 2002 |
| 6,533,709 | G. A. Jones | Mar. 18, 2003 |

Of these patents, the '179 patent issued to Murphy, et al. discloses a multi-function exercise machine providing a reclining position on which a user reclines below a suspended bar which is manipulated in pull-down exercises, or the user reclines proximal and forward of a pair of levered arms which are manipulated in forward pivoting exercises for conditioning the abdominal, chest and arm muscles. The exercise machine provides guided tracks along which the levered arms move in forwardly curved paths when gripped and moved by the user's arms. The forwardly curved paths of the pair of levered arms extend in front of the user's body when sitting, thereby exercising the pectoralis muscles of the user's chest. The configuration of the pair of levered arms forces the user to move his/her arms from an elevated position to a forward position, or from a side position to a forward position relative to the user's chest. The levered arms do not allow the user to outwardly extend and laterally move his/her arms for pushing against side units positioned adjacent to the user's sides and which are resistive to lateral movements due to connection with various amounts of stacked weights. Further, the pair of levered arms of the '179 patent do not allow a user to reciprocatingly move his/her arms laterally outwards from the torso, nor does the '179 patent allow for tensioned recovery movements of the arms laterally inwards to positions adjacent to the user's torso, while supporting weighted side units and thereby selectively strengthening the user's upper back muscle groups.

Chu, in the '941 patent, discloses an exercise machine providing a pair of downwardly extending and front pivoting arms which are positioned for rotational exercising the pectoralis chest muscles and to perform a chest press and a fly-type exercise consisting of a forward pivoting movement for the user's chest and arm muscles such as the pectoralis and biceps muscles. The front pivoting arms are supported by a pair of knuckle sockets and knuckles for rotation about a right and left knuckle axis, with the respective pivoting arms extending downwards for gripping by a user when positioned below the pivoting arms. Arm movements toward the user's chest are accomplished by the rotational movement of each spaced apart front pivoting arm, thereby providing for tensioned movements in a forwardly and crossing direction across the user's chest. The front pivoting arm movements disclosed by the '941 patent provide for frontal manipulation of the pectoralis muscles of the chest and the biceps muscles of the arms, but lacks the ability to provide outwardly extending and laterally directed arm movements pushing against a weighted unit, and does not provide for isolating and focused strengthening of each muscle group supporting the upper back.

Voris, in the '936 patent, discloses a multi-function exercise machine providing resistance for exercising the upper torso and arm muscles by providing a pair of downwardly extending front pivoting arms. The front pivoting arms are supported above the seated user along a central pivoting axis having stacked rotational joints with bearings allowing for rotation of the front pivoting arms relative to the central pivoting axis extending downwards through the user's torso. The '936 machine allows for one or both front pivoting arms to be manipulated in a forwardly and circular direction across the user's chest, but without allowing for outwardly extending and laterally directed arm movements pushing against a weighted unit and thereby lacking the ability to isolate and focused strengthening of each muscle group supporting the user's upper back.

Jones, in the '709 patent, discloses a standing push/pull exercise machine in which the user is positioned in a central position while manipulating hand levers in alternating forward and rearward movements with his/her right and left arms alternating in direction in order to strengthen the user's forearm muscles, biceps, abdominal muscles, gluteus and leg muscles. The '709 machine requires right and left pivoting devices on which weights are supported, and which are moved in alternating forward and rearward movements adjacent of the user's right and left sides. The '709 machine does not allow outwardly lateral motions by the user's arms, nor are arm movements allowed with the palms of the hands directed outwards from the user's sides.

There exists a need to provide an exercise machine which allows lateral arm movements which isolate, constantly tension and strengthen each of a user's muscle groups of the upper back and shoulders. An additional need exists to provide an exercise machine which allows a user seeking to strengthen his/her upper back to repetitively extend laterally outwardly and return laterally inwardly either one, or both, of the user's arms in order to push against weighted units positioned laterally adjacent to the user's shoulders. A further need exists for an exercise system providing a method of exercising in which a user fully extends laterally outwards and reciprocatingly retracts his/her arms relative to the torso while pressing against side units providing constant resistance to movement, in order to isolate, tension and strengthen each of the user's muscle groups of the upper back and rear shoulders.

BRIEF SUMMARY OF THE INVENTION

According to one embodiment of the present invention, an upper back exercise machine is disclosed for isolating, tensioning and exercising a user's upper back and shoulder muscles including the primary muscle groups referred herein as the upper, middle and lower trapezium, posterior deltoids, rhomboids, levator scapulae and latissimus dorsi. The above identified muscles are referred hereinafter as the upper back and outer shoulder muscle groups. The upper back exercise machine is also utilized for isolating, tensioning and exercising the triceps brachii, biceps, and brachioradialis muscles, which are referred hereinafter as the posterior and anterior upper arm muscle and forearm muscle groups.

The upper back exercise machine includes a substantially rigid frame including first and second outboard supports within which first and second stacked weight units are slidingly supported by each outboard support. The first and second stacked weight units include first and second sets of a plurality of weights stacked vertically. Each stack of weights, or a portion thereof as selected by the user, are reciprocatingly moved vertically upwards to any of a plurality of raised positions, and are lowered to a base or ground-level position by the user's operation of the upper back exercise machine.

The frame includes an upper cross-member connecting between the outboard supports, with the upper cross-member containing at least one upper roller track extended horizontally between the outboard supports. The frame also includes at least one pair of first and second inboard support units connecting with substantially horizontal pairs of first and second lateral members extending outwards to attach at about a mid-level height to the outboard supports. The first and second lateral members contain first and second lower roller tracks disposed generally horizontal along each lateral member. The respective first and second lower roller tracks extend laterally to align with and rigidly connect inboard at about the mid-level height of the outboard support units.

A first and second group of at least two pulleys provide support and redirect first and second cables which connect between the first and second sets of stacked weights and first and second crossbar members which are positioned within the frame for manipulation by the user. The first cable connects to an upper portion of a first inboard mounted crossbar member which is manipulated laterally outwards and inwards by the user. The second cable connects to a like-configured inboard mounted crossbar member which is manipulated laterally outwards and inwards by the user. The first and second crossbar members are positioned generally vertical, parallel to each other, and are spaced apart a distance adequate for a user to assume a central position between crossbar units.

Each inboard mounted crossbar member includes a plurality of vertically stacked hand-holds which the user grips with the palms of his/her hands turned outwardly, thereby allowing the user to laterally push and outwardly manipulate each crossbar member toward respective outboard supports of the frame. Each upper and lower opposed end of the first and second crossbar members include respective pairs of upper and lower rollers to provide ease of lateral movement along the respective upper and lower roller tracks upon outwards pushing or inwardly controlled return of each crossbar member by the user's manipulation. The user separately selects an appropriate number of weights for movement by the left hand, forearm, shoulder, and left back muscle groups. The same number of weights, or a different weight, can be selected for movement with the right hand, forearm, shoulder, and right back muscle groups.

The user preferably stands, or alternatively sits or reclines between the first and second crossbar members and pushes outwards with respective left and right palms turned outwards from the shoulders, with resulting lateral movements of the crossbar members directed in opposing directions away from the user's sides. The palms-out orientation of the user's hands and pushing against the crossbar members provide effective isolating, tensioning and strengthening of the muscle groups of the upper back, outer shoulders, upper arms and forearms, without wasted energy for correcting wayward motions by the arms or shoulder for balancing of free weights. The selective isolation and tensioning of the respective muscles of the forearms, upper arms, outer shoulders, and upper back muscles provide for rapid strengthening of those muscle groups without significant tensioning of the user's lower body muscle groups other than to maintain a standing or sitting posture. A method for isolating, exercising and strengthening upper back and shoulder muscles is also disclosed herein.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
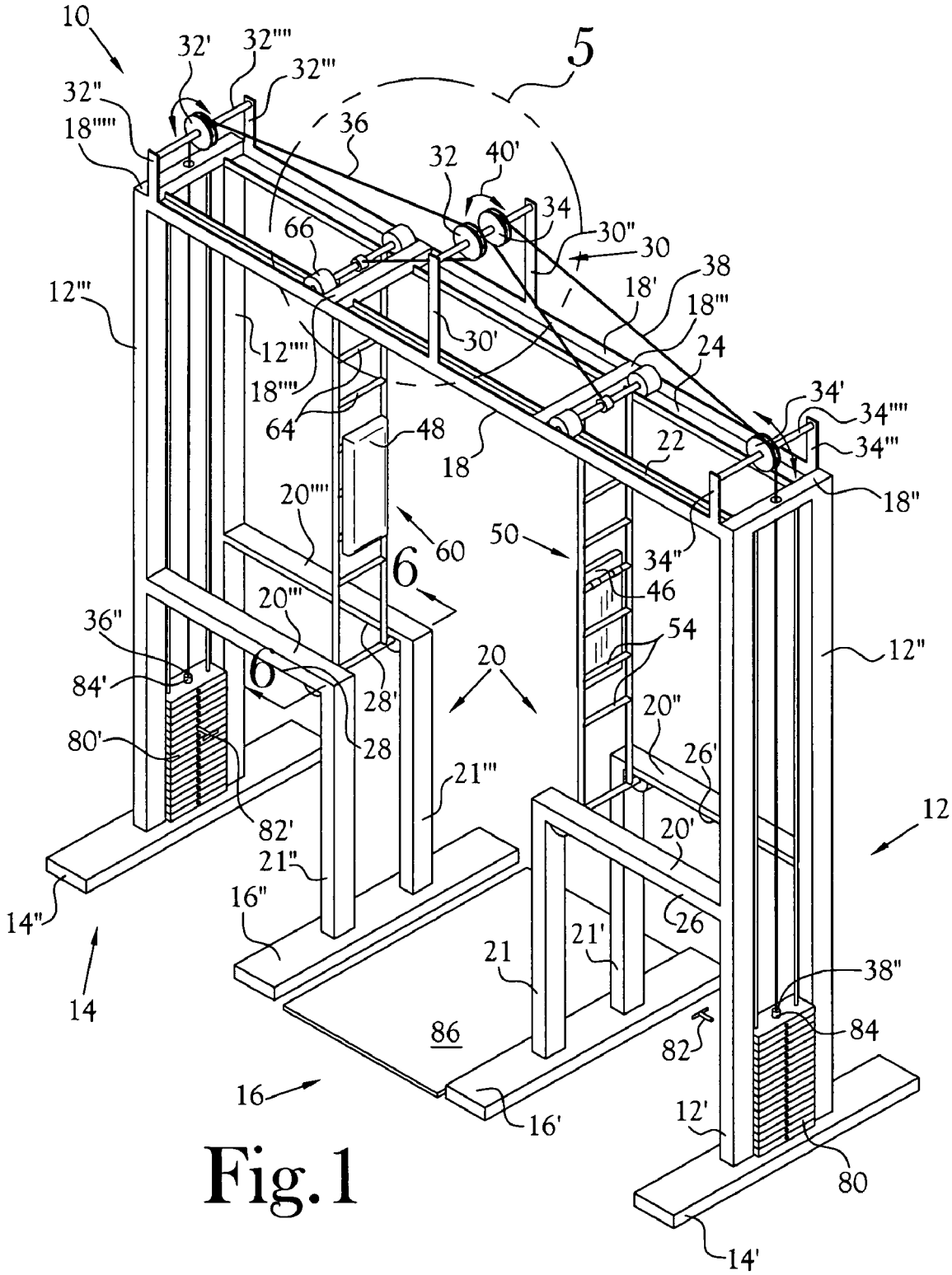
FIG. 1 is a perspective view of one embodiment of an upper back exercise machine of the present invention.
Figure 2:
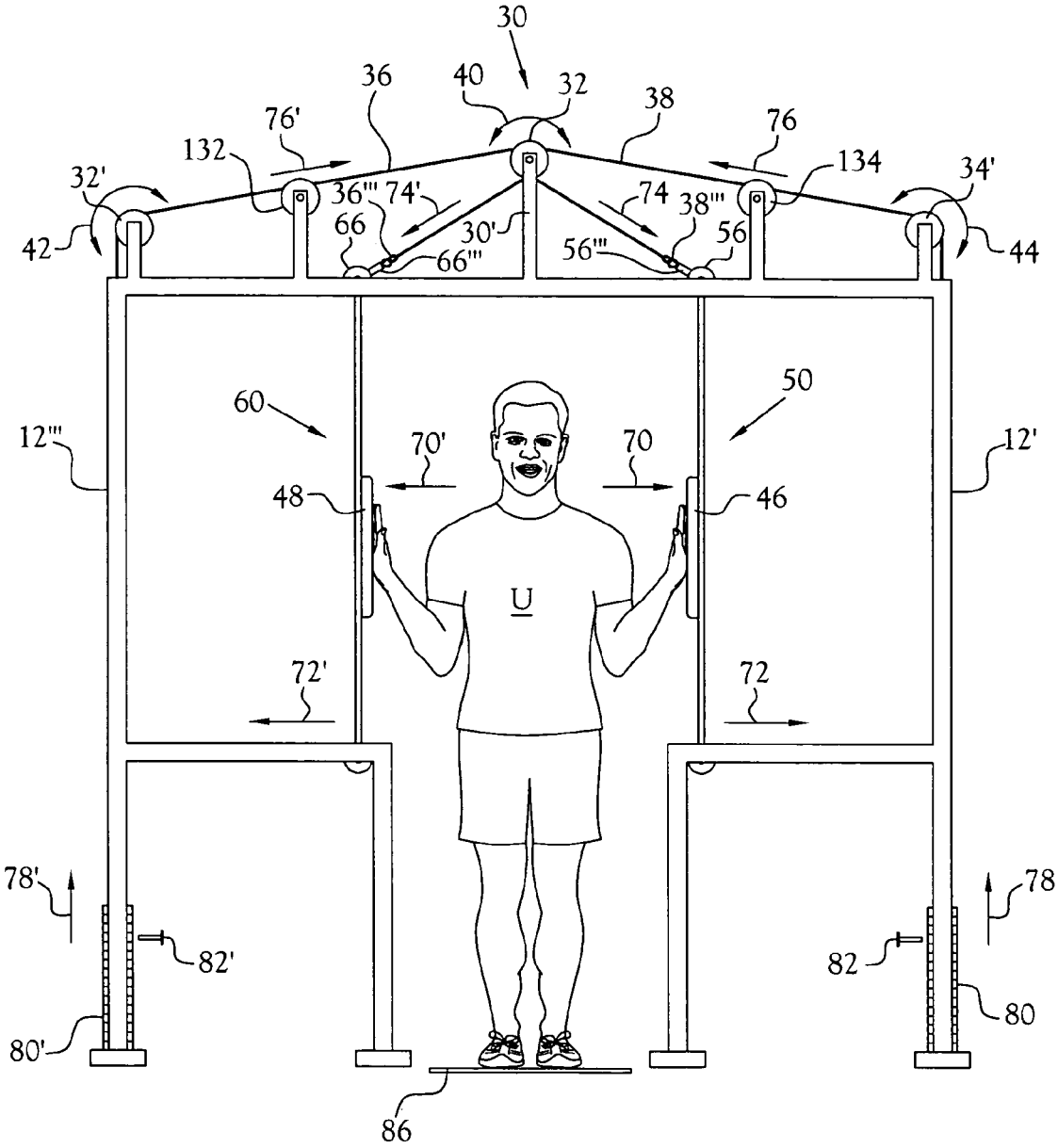
FIG. 2 is a front view of an alternative embodiment of the upper frame of the exercise machine of FIG. 1, with a user positioned to operate the machine.
Figure 3:
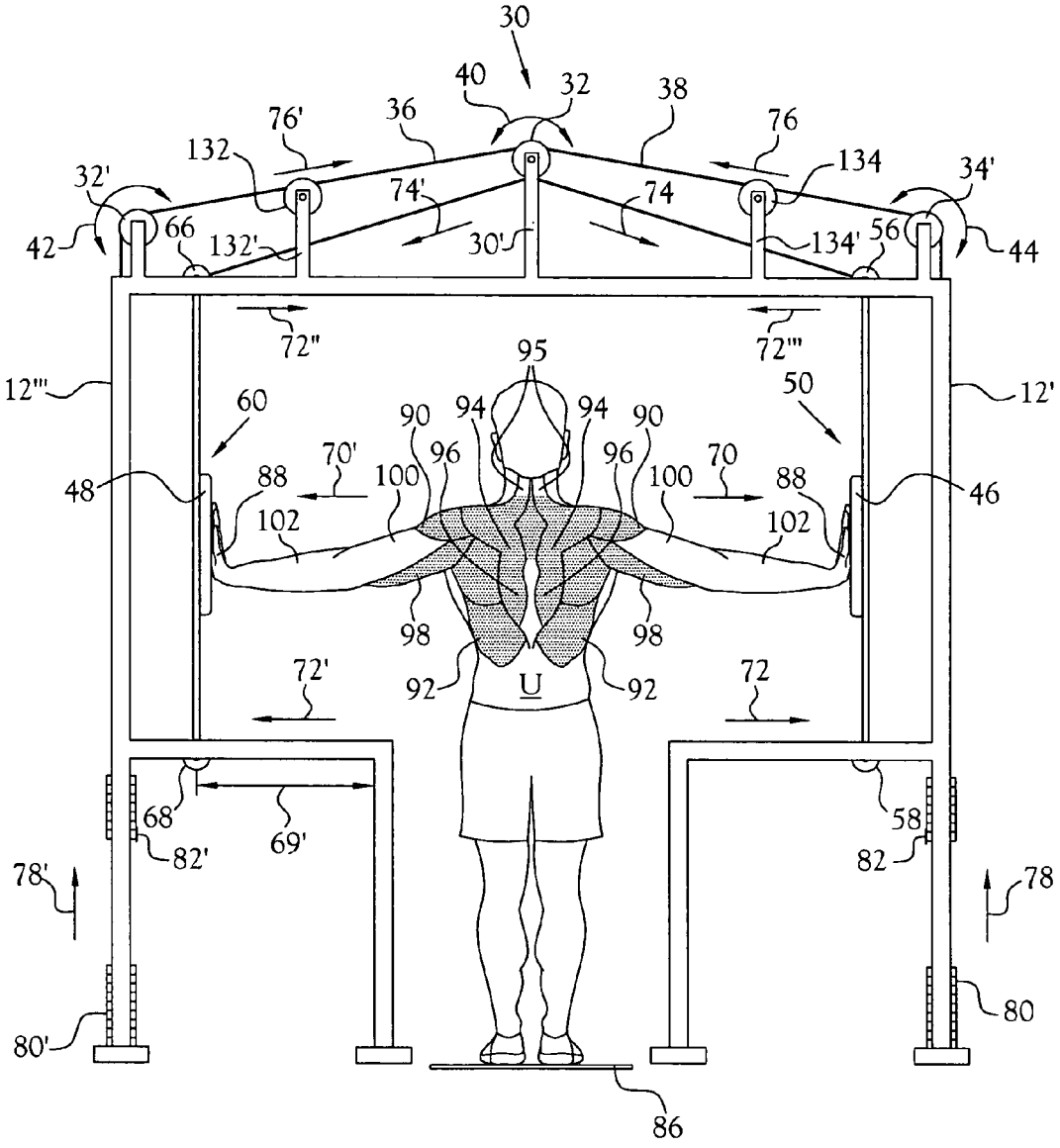
FIG. 3 is a front view of the exercise machine of FIG. 2, illustrating the upper back muscles utilized by a user during extension of the opposed side units.

An upper back exercise machine is disclosed as illustrated at 10 in FIGS. 1–3, for isolating and exercising a user's upper back and shoulder muscles including the deltoids 90, latissimus dorsi 92, rhomboids 94, levator scapulae 95, trapezius 96, and tricep brachii 98 muscles as illustrated in FIG. 3. A person's upper back muscles provide support and movement for a person's upper torso, arms and neck, therefore strengthening of the above identified muscles is important for a person, no matter whether a body-builder or a casual weight lifter. The above identified muscle groups include right and left pairs of muscles, which are each isolated, tensioned and strengthened by use of both right and left mechanisms of the upper back exercise machine 10. In addition, the configuration of the right and left mechanisms provide for development of the biceps 100 of the upper arm and the brachioradialis muscles 102 of each forearm. The positioning of the user U between the right and left mechanisms of the exercise machine 10, the palm-out orientation of the user's hands 88 against opposed crossbar units 50, 60, and the laterally directed outward and inward movements of the user's hands 88 and arms while being maintained under tension, provide a unique combination of body positioning and upper body and arm movements for rapid and effective strengthening of the upper back muscles from use of the exercise machine 10.

The frame 12 is supported above a supporting surface by substantially rigid outboard frame members including a first pair 12', 12" and a second pair 12''', 12'''' of vertically oriented outboard supports having elongated base supports 14', 14", and having horizontally oriented upper lateral frame having upper cross-members 18, 18' connecting between respective outboard supports 12', 12", 12''', 12''''. The height above a supporting ground surface of the upper lateral frame having cross-members 18, 18' is between about seven feet to about seven and a half feet. In order to rigidly support movements of first and second weight units 80, 80' carried by respective base supports 14', 14", and to resist lateral frame movements during a user's exercising motions, the upper lateral frame having cross-members 18, 18' are maintained in generally parallel orientation by use of spaced apart upper cross-supports 18", 18'''. The first and second pair of outboard supports 12', 12" and 12''', 12'''' are connected by respective pairs of upper cross-supports 18", 18'''' and interior cross-members 18''', 18'''' which provide structural rigidity for the frame 12. The upper cross-supports 18", 18'''' serve as supports for upwardly directed respective brackets 34", 34''' and 32", 32''', which support outer pulleys 34', 32' rotatably suspended by connecting rods 34'''', 32'''' (see FIGS. 1–3 and 7). An alternative embodiment for upper cross-members 18, 18' includes a right/first pair of upper roller tracks 22, 24 extended laterally from the first pair of outboard supports 12', 12", and a left/second pair of upper roller tracks 22, 24 extended laterally from the second pair of outboard supports 12''', 12''''. The first and second pair of upper roller tracks 22, 24 can include a gap separation (not shown) between each pair of upper roller tracks to allow movement apart of the pairs of outboard supports to accommodate an average shoulder width of a user when exercising on a floor pad 86. If a gap separation is utilized, the middle upper bracket supports 30', 30", 30''' (see FIG. 1) are shifted to extend from respective first and second pair of roller tracks. In the alternative embodiment, the first and second pair of outboard supports 12', 12" and 12''', 12'''' are free-standing, or are anchored to adjacent walls or ceiling to further stabilize the outboard supports 12', 12" and 12''', 12''''.

Figure 6:
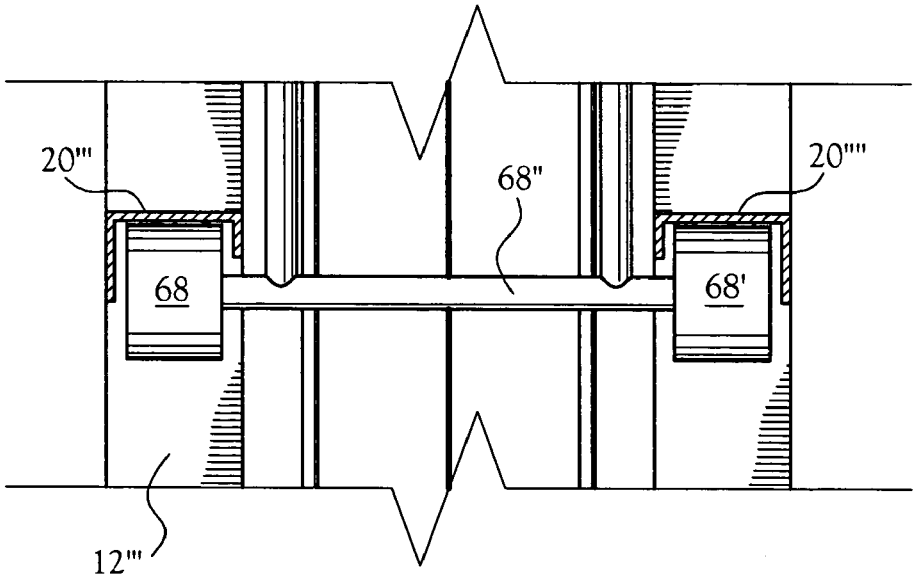
FIG. 6 is a section view along 6—6 of FIG. 1, illustrating an underside view of a pair of lower roller tracks in which roller wheels move of the crossbar unit.
Figure 7:
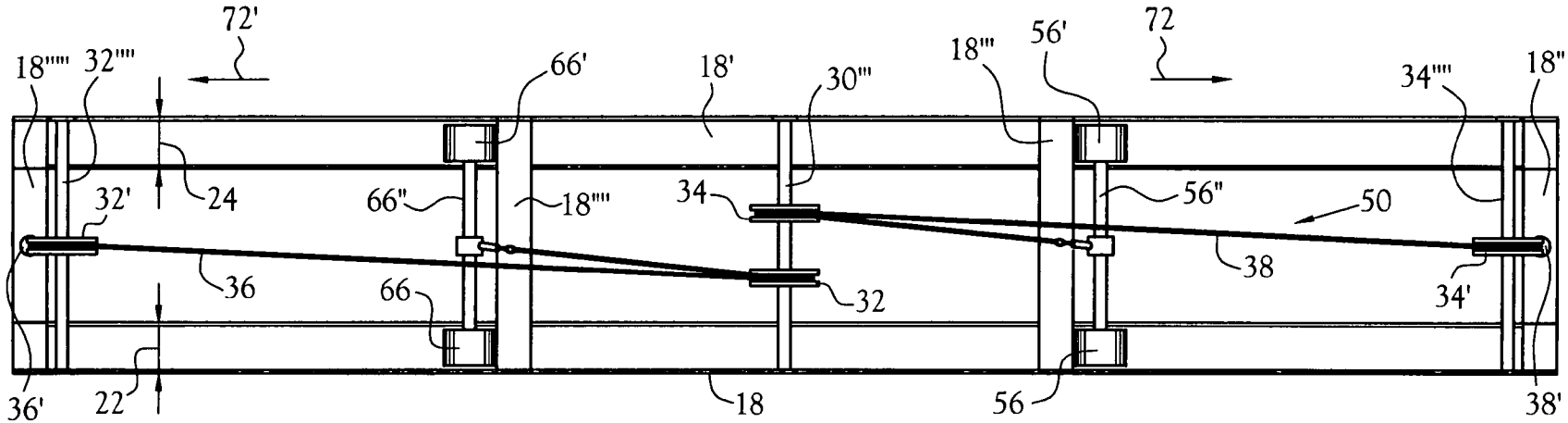
FIG. 7 is a top view of a pair of upper channels in the upper frame cross-member illustrating pairs of upper rollers of first and second crossbar members positioned to move laterally when a user moves the crossbar members.

The frame 12 further includes a pair of inboard supports 20 composed of a first pair of vertically oriented inboard frame legs 21, 21' and a second pair of vertical inboard frame support legs 21", 21''' which are supported at a ground level by a base unit 16 including right and left base members 16', 16". The first and second inboard supports 20 extend upwards a sufficient height to connect with substantially horizontal right and left pairs of lateral members 20', 20" and 20''', 20''''. The right and left pair of lateral members extend horizontally in spaced-apart orientation and are joined at outboard ends at about a height of between about two and a half feet to about three and a half feet to the outboard supports 12', 12'''. On an underside of each pair of lateral members 20', 20" and 20''', 20'''' is included first and second pairs of lower roller tracks 26, 26' and 28, 28' disposed horizontally and aligned underneath each pair of lateral members (see FIG. 6). The respective pairs of lower roller tracks extend the full length between the outboard supports 12', 12", 12''', 12'''' and the first and second pairs of inboard supports 20, 20. The outboard ends of each lower roller track 26, 26', 28, 28' abut interior faced sides of outboard supports 12', 12", 12''', 12'''' (see FIG. 6).

Within each base of the outboard supports 12', 12''', first and second weight units 80, 80' are positioned in separately stacked arrangements such that a portion of the weights in either stack, or portions of both weight units are separately moved vertically during the user's exercising movements when positioned centrally within the frame 12 on a floor pad 86 (see FIGS. 1–3). The first and second weight units 80, 80' are supported in respective vertically oriented slide tracks in each outboard support 12', 12'''. As is typical of prior stacked weight configurations, a portion of each stack of weights is selected for lifting by the user inserting an elongated key 82, 82' under the appropriate number of stacked weights for either weight units 80, 80', which the user intends to reciprocatingly move upwards to any of a plurality of raised positions (see FIG. 3). Each stacked weight units 80, 80' also provide constant tension for stressing the user's hands, arms and upper back muscles as the stacked weights are lowered by the user to a base or ground-level position (see FIG. 2).

Lateral outward movements by the user's arms and hands 88 pushing against opposed crossbar units 50, 60 are transmitted to the stacked weight units 80, 80' by a cable and pulley system 30 having a first and second group of overhead pulleys 32, 32' and 34, 34' which rotatably support respective first connecting cable 36 and second connecting cable 38 which are redirected through respective central holes 36', 38' in respective end cross-members 18'''', 18" for extension to connect at respective first cable ends 36", 38" with respective opposed stacked weight units 80, 80'. The first pulley group 32, 32' is devoted to providing first redirecting means for cable 36 extended between one stack of weights 80' and one inboard mounted crossbar unit 60. The second pulley group 34, 34' is devoted to providing second redirecting means for cable 38 extended between a stack of weights 80 and another inboard mounted crossbar unit 50. The crossbar units 50, 60 are positioned generally parallel to each other when in a neutral or first position, and are separated by a spaced apart distance adequate for a user to position in a central position between the crossbar units.

One skilled in the art will recognize that additional pulleys 132, 134 can be utilized to further support and redirect the respective cables 36, 38 during cable movements. As illustrated in FIGS. 2 and 3, additional pulleys 132, 134 are supported to rotate above a left section and a right section of the upper lateral frames 18, 18' by supports 132', 134'. An alternative pulley system can be utilized by one skilled in the art with overhead pulleys relocated to alternative positions extending from end cross-members 18", 18'''' while providing redirection of cables 38, 36 to the appropriate stacked weights 80, 80'. One skilled in the art will further recognize alternative pulley system and guiding track configurations for channeling movements of upper and lower ends of crossbar units 50, 60 by providing sliding devices in at least one upper channel and at least two lower spaced apart and aligned channels having adequate separation to allow a user to stand, sit or recline therebetween in a central position while positioning his/her shoulders adjacently inboard of crossbar units 50, 60.

Figure 4:
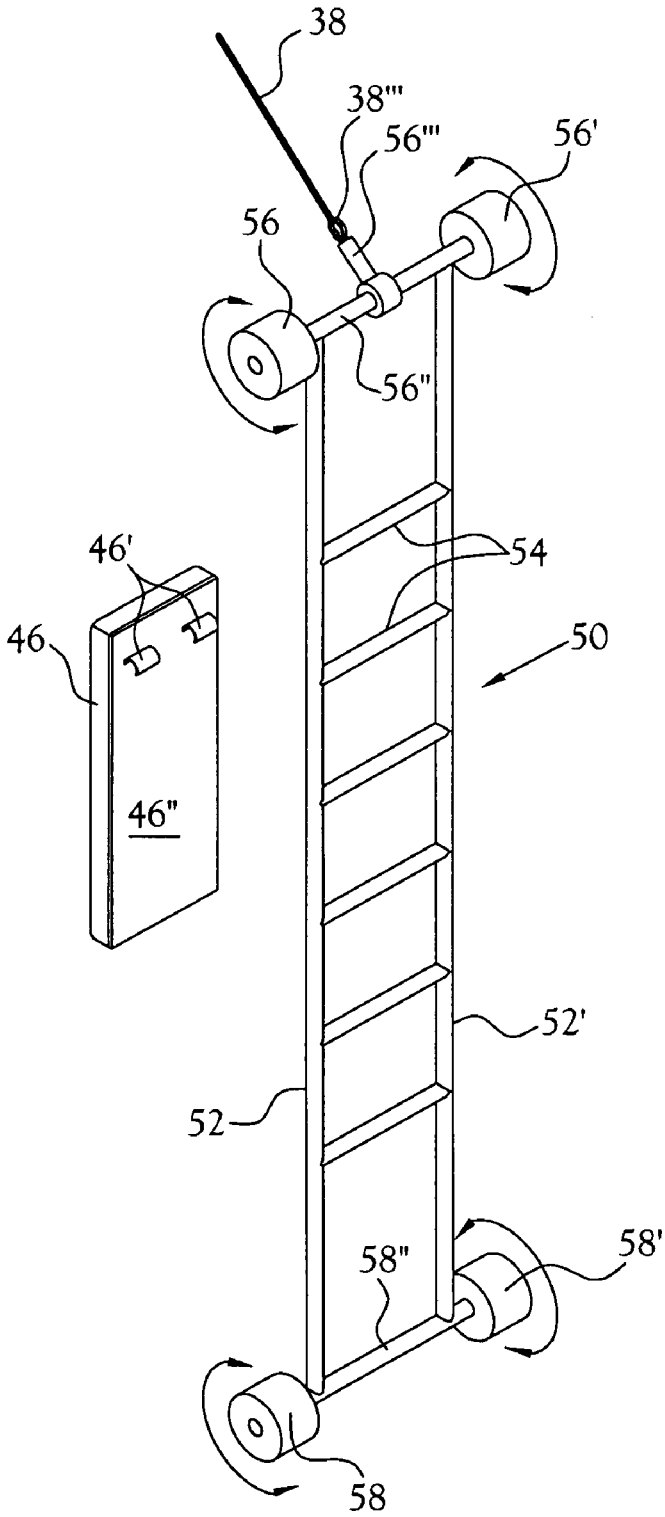
FIG. 4 is a perspective view of a crossbar member and an attachable pad utilized in operation of the exercise machine of FIG. 1.
Figure 5:
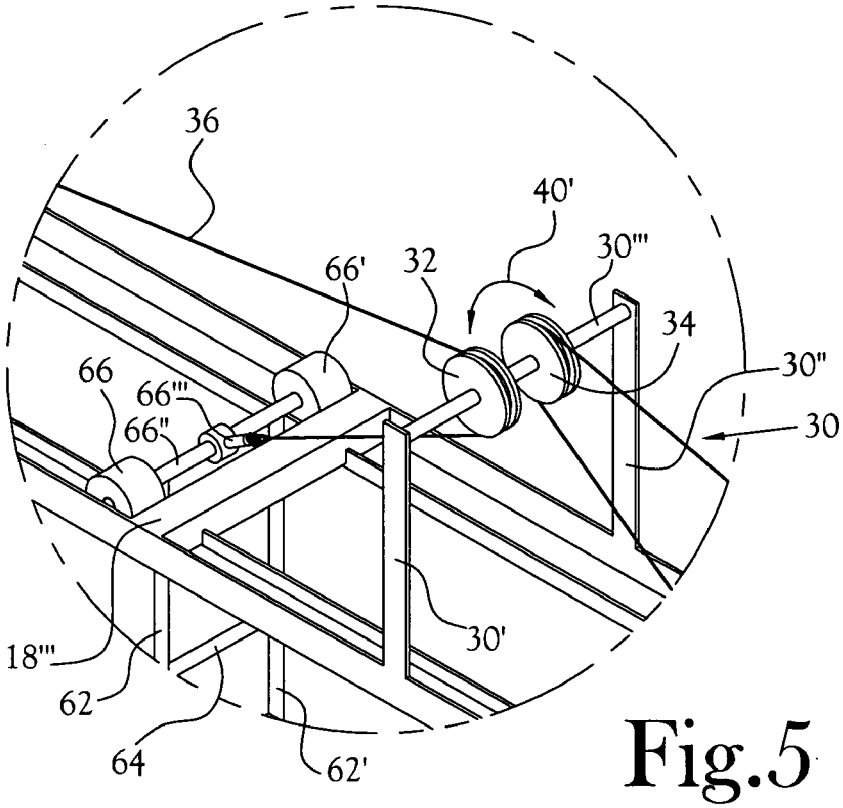
FIG. 5 is a detail view along 5—5 of FIG. 1, illustrating a pair of central pulleys of an overhead cable and pulley system.

Each like-configured inboard mounted crossbar units 50, 60 includes frame members 52, 52' and 62, 62', each pair of frame members supporting a plurality of spaced apart ladder-type cross 54, 64 and providing hand holds at a variety of selected heights for the user to grip when the crossbar units 50, 60 are mounted as illustrated in FIGS. 1–3. In regards to crossbar unit 50, an upper end is delineated by cross-member 56", having a pair of rollers 56, 56' extended from opposed ends. In a mid-point of the cross-member 56" is a pivoting swivel 56'" which is releasably connectable by a typical hook and loop connection 38'" to the overhanging cable 38. A lower end of crossbar unit 50 is delineated by cross-member 58", having a pair of rollers 58, 58' extended from opposed ends (see FIG. 4). An optional device is an attachable pad 46 which is provided with hook connectors 46' for positioning on any one of the cross 54 at a height adjacent to the user's outwardly extended palm of right or left hand 88. The attachable pad 46 can include padding on the inwardly faced surface, and a hard backing 46" on the outwardly faced surface. In regards to like-configured crossbar unit 60, an upper end is delineated by cross-member 66", having a pair of rollers 66, 66' extended from opposed ends. In a mid-point of the cross-member 66" is a pivoting swivel 66'" which is releasably connectable by a typical hook and loop connection 36'" to the overhanging cable 36 (see FIG. 5). A lower end of crossbar unit 60 is delineated by cross-member 68", having a pair of rollers 68, 68' extended from opposed ends (see FIG. 6). An optional device is an attachable pad 48 which is provided with hook connectors 48' for positioning on any one of the cross 64 at a height adjacent to the user's outwardly extended palm of right or left hand 88. The attachable pad 48 includes padding on an inwardly faced surface, and a substantially rigid backing 48" on an outwardly faced surface.

During use of the exercise machine 10, the user U grips either of the opposed pairs of hand-holds provided by cross 54, 64 with the palms of his/her hands 88 turned outwardly, thereby allowing the user to laterally push outwards 70, 70' by manipulating each crossbar unit 50, 60 in the direction 72, 72' of respective outboard supports 12', 12'". The user may elect to attach the attachable pads 46, 48 for the user to push outwards 70, 70' against each crossbar unit 50, 60. When pads and crossbar units 50, 60 are moved, respective pairs of upper rollers 56, 56', 66, 66' are moved within respective upper roller tracks 22, 24 (see FIG. 7), and lower rollers 58, 58', 68, 68' are moved respectively within lower roller tracks 26, 26' and 28, 28' (see FIG. 6). Outwardly movements 72, 72' of respective crossbar units 50, 60 result in tensioning of swivel connectors 56'", 66'" and angled movements 74, 74' and 76, 76' of cables 38, 36. For the embodiment illustrated in FIGS. 1–3, the crossbar unit 60 is connected by at least one cable 36 which is redirected by rotation 40 of pulley 32, and rotation 42 of pulley 32' in order for cable 36 to be connected to a sleeve or bracket 84' inserted into second stack of weights 80'. The opposed crossbar unit 50 is independently connected by at least one cable 38 which is redirected by rotation 40' of pulley 34, and rotation 44 of pulley 34' in order for cable 38 to be connected to a sleeve or bracket 84 inserted into the first stack of weights 80. The user separately selects an appropriate number of weights 80, 80' to lift with either or both hands 88 by insertion of respective elongated pins 82, 82' into each respective sleeve or bracket 84, 84' to select an appropriate number of stacked weights 80, 80' for movement above each base or neutral position (see FIG. 2) to an elevated position (see FIG. 3), thereby exercising the forearm, upper arm, shoulder, and upper back muscle groups.

The exercise machine 10 provides the user with the option of exercising in a standing posture (see FIG. 2), or alternatively in a sitting posture or a reclining posture on an appropriately sized bench (not shown) positioned between the crossbar units 50, 60. The user U preferably positions his/her respective left and right hands 88 with palms turned outwards from the shoulders, with resulting lateral movements of the tensioned side units directed in opposing directions 72, 72' away from the user's sides. The palm-out placement of the user's hands 88 against the tensioned crossbar units 50, 60 provides effective isolating and tensioning of the upper back muscle groups originating along the user's spine and extending to the outer and posterior shoulder muscles. The palm-out placement of the hands 88, and the maintenance of tension on the cables 36, 38 during lateral outwards movements 72, 72' and inwardly directed return movements 72", 72'" further isolates and tensions the upper back muscle groups 92, 94, 95, 96, the triceps muscles 98 and biceps muscles 100 of the arms, and the forearm muscles 102, without significant stress imposed on the user's lower back or lower body muscle groups during typical balancing and correcting movements required of a user exercising with free weights (not shown).

A method for isolating and exercising specific upper back muscle groups includes the step of providing an exercise machine 10 having a frame 12, a pulley system 30 including a plurality of pulleys, and a cable system 38, 36 extending from opposed crossbar units 50, 60, and connecting to two sets of a plurality of stacked weights 80, 80'. A step of positioning includes the user assuming a central position of standing on a floor pad 86, or assuming a sitting or reclining position between opposed crossbar units 50, 60, with the central position providing for the user's shoulders to be positioned inwardly and adjacent of respective crossbar units 50, 60. The user will grab each respective crossbar unit 50, 60 with his/her hands in a palms-out orientation. Alternatively, the user will attach first and second height adjustable pads 46, 48 with his/her hands 88 pushed against respective pads in a palms-out orientation. A step of extending includes outwardly directed pushing movements 70, 70' with the user's hands 88 maintained in palms-out orientation, and resulting in lateral outwardly movements 72, 72' of opposed crossbar units 50, 60, which results in tensioning and moving of cables 38, 36 and lifting of one of more of the weights in the pairs of stacked 80', 80. A step of pausing includes the user retaining his/her arms in extended positions in palms-out orientation against the opposed crossbar units 50, 60 for a few moments in order to fully flex and tension the user's upper back muscles. A step of retracting includes the user gradually retracting each arm, either in unison or in staggered movements inwardly in order to return the opposed crossbar units 50, 60 to neutral or starting positions (see FIG. 2). At the end of the step of retracting, the user can repeat the steps of extending, pausing and retracting as many times as the user prefers, or the user can alternatively follow an additional step of repositioning the user's hands to higher or lower gripping positions on the opposed crossbar units 50, 60, and repeating the steps of extending, pausing and retracing his/her arms and hands to positions proximal of the user's shoulders. The steps of extending, pausing and retracting the user's arms and hands 88 in palms-out orientation will provide for tensioning and isolating of the user's upper back muscles during each sequence of steps, thereby strengthening the user's upper back, arm and forearm muscles without significant stress imposed on the user's lower back or lower body muscle groups as imposed to prior weight lifting exercises typically requiring balancing and correcting movements of a user exercising with free weights (not shown).

The upper back exercise machine 10 includes various functions which operate in concert in order to isolate, tension and strengthen each of the user's upper back muscle groups, outer shoulder muscles, upper posterior arm muscles and forearm muscles. The function of isolating is implemented by the step of positioning with the user assuming a central position of standing on a floor pad 86, or assuming a sitting or reclining position between opposed crossbar units 50, 60, with the central position providing for the user's shoulders positioned inwardly and adjacent of respective crossbar units 50, 60, thereby isolating the upper back muscle groups for up/down or forward/backward movements. The function of tensioning is implemented by the step of extending outwardly directed pushing movements 70, 70' by the user's hands 88 maintained in palms-out orientation, and resulting in lateral outwardly movements 72, 72' of opposed crossbar units 50, 60, resulting in tensioning and moving of cables 38, 36 and lifting of one of more of the weights in the pairs of stacked weights 80', 80. The function of strengthening is a combination of the implementation of steps of positioning, extending the user's arms and hands 88 maintained in palms-out orientation against the opposed crossbar units 50, 60, pausing the arms in the extended position, and retracting the arms and hands 88 to the neutral position.

From the foregoing description, it will be recognized by those skilled in the art that an upper back exercise machine 10 is provided which selectively isolates certain muscle groups, with resulting tensioning and strengthening of the muscle groups of the user's upper back and shoulders. Further, those skilled in the art will recognize that the upper back exercise machine 10 is utilized with the user in standing, sitting or reclining positions, either faced forwards or backwards, while maintaining the user's hands in palms-out orientation during all steps.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, I claim:

1. An exercise apparatus to strengthen upper back and shoulder muscles, comprising:

a frame including spaced apart outboard supports and a set of weights reciprocatingly disposed within at least one of said outboard supports, said frame including an overhead frame extended inboard from an upper portion of one outboard support, said overhead frame supporting an upper roller track therein;

an inboard support positioned between said outboard supports, said inboard support having a lower roller track supported in aligned orientation below said upper roller track of said overhead frame;

a crossbar extended between said aligned upper and lower roller tracks, said crossbar is supported in a non-tensioned position proximal to and adjacent said inboard support, said crossbar is moved laterally by a user to a tensioned position proximal of one of said outboard supports while said crossbar is supported between said aligned upper and lower roller tracks; and a cable system supported by said frame, said cable system having at least one cable extended between said set of weights and said crossbar;

whereby the user assumes a position adjacent said crossbar and reciprocatingly manipulates said crossbar outwardly from said non-tensioned position to said tensioned position with either palm directed outwards against said crossbar for reciprocatingly pushing and pulling said crossbar thereby raising and lowering said set of weights with resulting strengthening the user's upper back and shoulder muscles.

2. The exercise apparatus of claim 1, wherein said crossbar further including a first and second crossbar spaced apart and suspended from said overhead frame, each crossbar having a plurality of hand-holds thereon, said hand-holds being horizontally positioned in spaced-apart orientation, whereby the user assumes a central position between said first and second crossbars in either forwards or backwards positions with both hands extended in palms-out orientation for placement against any one of said plurality of hand-holds during outwards pushing against each crossbar to said tensioned position and inwards pulling of each crossbar to said non-tensioned position with the user remaining in the central position between said first and second crossbar.

3. An exercise apparatus for strengthening upper back and shoulder muscles, comprising:

a frame including a pair of outboard supports positioned vertically and containing therein respective pairs of slide tracks in which sets of stacked weights are positioned to be reciprocated vertically within respective slide tracks, said frame including an upper cross-member connecting between said outboard supports, said upper cross-member containing an upper roller track extended between said outboard supports;

a pair of inboard supports positioned in spaced apart orientation and adjacently interior of respective outboard supports, each inboard support unit includes a lateral member extending outwards to connect to respective outboard supports, each lateral member supporting separate lower roller tracks thereon;

a first and second crossbar disposed in spaced apart orientation for reciprocating movement laterally toward respective outboard supports while being vertically supported between said upper roller track and separate lower roller tracks; and a cable system including a pair of cables supported by a plurality of pulleys including one cable being extended between one set of stacked weights and said first crossbar, and a second cable being extended between a second set of stacked weights and said second crossbar;

whereby a user assumes a central position between said crossbars and reciprocatingly manipulates each crossbar outwardly and inwardly with the user's hands and palms directed outwards with resultant tensioning of each pair of cables and reciprocating raising and lowering of respective sets of stacked weights thereby strengthening the user's upper back and shoulder muscles.

4. The exercise apparatus of claim 3, further comprising:

each crossbar including an upper connector end having a pair of opposed upper rollers extend laterally, whereby said opposed upper rollers for each crossbar are disposed in spaced apart orientation within said upper roller track of said upper cross-member;

a lower end for each crossbar from which a pair of opposed lower rollers extend laterally, whereby said opposed lower rollers of each crossbar are disposed within said lower roller tracks of respective lateral members; and a plurality of hand-holds on each crossbar, said hand-holds being spaced apart and horizontally stacked between said upper end and said lower end of each crossbar, whereby the user assumes the central position between said crossbars and is positioned either forwards or backwards with both hands extended in palms-out orientation for gripping one of said plurality of hand-holds on each crossbar during outwards and inwards movement of said crossbars.

5. The exercise apparatus of claim 4 wherein said pair of inboard supports further including:

a first and second vertical member extending from a lower supporting surface to a sufficient height and joined to support each respective first and second lateral member such that each lateral member extends substantially horizontally outwards from respective vertical members for a sufficient length for joined connection at about a mid-level height of respective first and second outboard supports; and said first lateral member having a first pair of lateral members extending in parallel orientation outwards from said first vertical member for joined connection to said first outboard support, said first pair of lateral member having respective underside surfaces in which a first pair of lower roller tracks are disposed for acceptance therein of respective lower ends and opposed lower rollers of said first crossbar;

said second lateral member having a pair of lateral members extending in parallel orientation and outwards from said second vertical member for joined connection to said second outboard support, said first pair of lateral members having respective underside surfaces in which a second pair of lower roller tracks are disposed for acceptance therein of respective lower ends and opposed lower rollers of said second crossbar;

whereby each crossbar is maintained in substantially parallel orientation during outwards and inwards movement as guided by said upper roller track and each respective pair of lower roller tracks for separate and independent manipulation outwardly and inwardly by the user in said central position.

6. The exercise apparatus of claim 3 wherein said cable system further including:

said plurality of pulleys supported from said upper cross-member;

said first cable originating at a releasable first connector attachable to a first stacked plate bracket supporting any combination of one or more weights as selected by the user of said first set of stacked weights, said first cable is extended substantially vertical upwards through said first outboard support to said upper cross-member from which a first outer pulley of said plurality of pulleys is extended above said first outboard support with said first cable directed by said first outer pulley toward a first central pulley extended proximally above a mid-line portion of said upper cross-member, said first cable is redirected by said first central pulley to extend downwardly to attach at a first cable second end to said upper end of said first crossbar, whereby upon said first crossbar being manipulated outwardly and inwardly by one of the user's hands, said first set of stacked weights is moved within said first outboard support; and said second cable originating at a releasable second connector attachable to a second stacked plate bracket supporting any combination of one or more weights as selected by the user of said second set of stacked weights, said second cable is extended substantially vertical upwards through said second outboard support to said upper cross-member from which a second outer pulley of said plurality of pulleys is extended above said second outboard support with said second cable directed by said second outer pulley toward a second central pulley extended proximally above said mid-line portion of said upper cross-member, said second cable is redirected by said second central pulley to extend downwardly to attach at a second cable end connected to said upper end of said second crossbar, whereby upon said second crossbar being manipulated outwardly and inwardly by one of the user's hands, said second set of stacked weights is moved within said second outboard support;

whereby the user reciprocatingly extends and retracts both arms laterally with respective right and left hands moving said first and second crossbars outwardly from the user's sides followed by inwardly arm movements with resultant movements of said first and second cables across respective pulleys for reciprocatingly raising and lowering respective sets of stacked weights thereby strengthening the user's upper back and shoulder muscles without significant movements of the user's lower body.

7. An exercise apparatus for strengthening upper back and shoulder muscles, comprising:

a frame including first and second outboard supports having respective base supports of sufficient size to maintain said frame in a vertical orientation above a supporting surface, said first and second outboard supports having therein respective first and second slide tracks in which a first and second set of stacked weights are positioned to be reciprocated vertically as guided by said first and second slide tracks, said frame further including an upper cross-member in which a pair of aligned upper roller tracks are extended between opposed junction ends connected to upper portions of said first and second outboard supports;

a pair of inboard supports positioned in spaced apart orientation and interior of respective opposed outboard supports, said pair of inboard supports extended above a supporting surface at about a mid-level height of a user positioned between said pair of inboard supports;

a first and second pair of lateral members extending outwards from said inboard supports for attachment to respective outboard supports, each lateral member having underside surfaces in which lower roller tracks are disposed;

a first and second crossbar disposed inboard of and generally parallel with respective first and second outboard supports, said first and second crossbars having at least one hand-hold therein, said first and second crossbars having opposed ends from which pairs of rollers extend for guided containment in respective upper and lower roller tracks whereby said crossbars are horizontally manipulated outwardly toward respective first and second outboard supports; and a first and second cable system supported by said frame, said first cable system is extended between said first set of stacked weights and said first crossbar, said second cable system is extended between said second set of stacked weights and said second crossbar;

whereby a user is positioned between said first and second crossbars and reciprocatingly pushes each first and second crossbars outwardly with the user's hands having palms directed outwards from the user's sides with resultant tensioning of said first and second cable systems and reciprocating raising and lowering of respective first and second sets of stacked weights thereby strengthening the user's upper back and shoulder muscles without significant movements of the user's lower body.

8. The exercise apparatus of claim 7, further comprising:

an upper end for each first and second crossbar from which a pair of opposed upper rollers extend laterally, whereby said opposed upper rollers of each crossbar are disposed within said at least one upper roller track of said upper cross-member;

a lower end for each crossbar from which a pair of opposed lower rollers extend laterally, whereby said opposed lower rollers of each crossbar are disposed within said lower roller tracks of each first and second lateral members; and a plurality of hand-holds on each crossbar, said hand-holds being spaced apart and horizontally stacked between said upper end and said lower end of each crossbar, whereby the user in the central position between the crossbars is positioned to face forwards or backwards with both hands extended in palms-out orientation for gripping any one of said plurality of hand-holds on said first and second crossbar during outwards and inwards manipulation of said crossbars.

9. The exercise apparatus of claim 7 wherein said inboard supports further including:

a first and second vertical member extending from a lower supporting surface to a sufficient height and joined to support each respective first and second lateral member such that each lateral member extends substantially horizontally outwards from respective vertical members for a sufficient length for joined connection at about a mid-level height of respective first and second outboard supports; and said first lateral member having a first pair of lateral members extending in parallel orientation outwards from said first vertical member for joined connection to said first outboard support, said first pair of lateral member having respective underside surfaces in which a first pair of lower roller tracks are disposed for acceptance therein of respective lower ends and opposed lower rollers of said first crossbar; and said second lateral member having a pair of lateral members extending in parallel orientation and outwards from said second vertical member for joined connection to said second outboard support, said first pair of lateral members having respective underside surfaces in which a second pair of lower roller tracks are disposed for acceptance therein of respective lower ends and opposed lower rollers of said second crossbar;

whereby said first and second crossbars are maintained in substantially parallel and vertical orientation by said upper roller track and respective first and second lower roller tracks, for separate and independent manipulation outwardly and inwardly by the user in said central position.

10. The exercise apparatus of claim 7 wherein said first and second cable systems further including:

a plurality of pulleys extended from said upper cross-member;

said first cable system having a first cable originating at a releasable first connector attachable to a first stacked plate bracket supporting any combination of one or more weights as selected by the user of said first set of stacked weights, said first cable is extended substantially vertical upwards through said first outboard support to said upper cross-member from which a first outer pulley of said plurality of pulleys is extended above said first outboard support with said first cable directed by said first outer pulley toward a first central pulley extended proximally above a mid-line portion of said upper cross-member, said first cable is redirected by said first central pulley to extend downwardly to attach at a first cable second end to said upper end of said first crossbar, whereby upon said first crossbar being manipulated outwardly and inwardly by one of the user's hands, said first set of stacked weights is moved within said first outboard support; and said second cable system having a second cable originating at a releasable second connector attachable to a second stacked plate bracket supporting any combination of one or more weights as selected by the user of said second set of stacked weights, said second cable is extended substantially vertical upwards through said second outboard support to said upper cross-member from which a second outer pulley of said plurality of pulleys is extended above said second outboard support with said second cable directed by said second outer pulley toward a second central pulley extended proximally above said mid-line portion of said upper cross-member, said second cable is redirected by said second central pulley to extend downwardly to attach at a second cable end connected to said upper end of said second crossbar, whereby upon said second crossbar being manipulated outwardly and inwardly by one of the user's hands, said second set of stacked weights is moved within said second outboard support;

whereby the user reciprocatingly extends and retracts both arms laterally with respective right and left hands moving said first and second crossbars outwardly from the user's sides followed by inwardly arm movements with resultant movements of said first and second cables across respective pulleys for reciprocatingly raising and lowering respective sets of stacked weights thereby strengthening the user's upper back and shoulder muscles without significant movements of the user's lower body.

11. A method for strengthening a user's upper back and shoulder muscles, comprising the steps of:

positioning the user in a central upright position having the user's hands and arms in neutral lateral positions between opposed movable crossbars supported in a non-tensioned position by a frame providing support of first and second cable systems connecting between said movable crossbars and first and second sets of a plurality of stacked weights, said step of positioning including the user's shoulders being positioned inwardly adjacent of respective opposed movable crossbars supported in the first position;

extending the user's arms and hands in outwardly directed pushing movements against respective opposed movable crossbars with the user's hands maintained in palms-out orientation, said step of extending providing lateral outwardly movements of the user's arms and hands against said opposed movable crossbars extended to a second position apart from the user's shoulders while moving said first and second cables and thereby lifting said opposed first and second sets of said plurality of stacked weights;

retaining the user's arms and hands in desired extended positions with palms-out orientation against said opposed movable crossbars thereby tensioning the user's upper back muscles and shoulder muscles; and retracting the user's arms and hands in gradual retracting movements toward the user's shoulders thereby returning the user's arms and hands to neutral lateral positions with said opposed movable crossbars at said first position proximal of the user's shoulders.

12. The method of claim 11, further comprising a step of repositioning the user's hands to higher or lower gripping positions on said opposed movable crossbars, and repeating said steps of extending the user's arms and hands in outwardly directed pushing movements, retaining the user's arms and hands in desired extended positions, and retracting the user's arms and hands in gradual retracting movements toward the user's shoulders thereby returning the user's arms and hands to the neutral lateral positions with said opposed movable crossbars returned to said first position proximal the user's shoulders.

* * * * *